US005411107A

United States Patent [19]

Hailey et al.

[11] Patent Number: 5,411,107

[45] Date of Patent: May 2, 1995

[54] COIL TUBING HYDRAULIC JAR DEVICE

[76] Inventors: Charles D. Hailey, 11628 Burning Oaks, Oklahoma City, Okla. 73150; Ronald M. Beagle, 4129 Division St., Metairie, La. 70002

[21] Appl. No.: 100,929

[22] Filed: Aug. 3, 1993

[51] Int. Cl.[6] ..... E21B 31/113

[52] U.S. Cl. ..... 175/296; 175/297; 166/301

[58] Field of Search ..... 175/296, 297, 293, 300; 166/301

[56] References Cited

U.S. PATENT DOCUMENTS

| | | | |
|---|---|---|---|
| 4,462,471 | 7/1984 | Hipp | 175/296 |
| 4,862,958 | 9/1989 | Pringle | 166/385 X |
| 5,052,485 | 10/1991 | Reid | 175/297 X |

OTHER PUBLICATIONS

Anadrill Hydraulic Jars Operation and Maintenance Manual (7th Ed.), (date unknown).

*Primary Examiner*—Terry Lee Melius

*Attorney, Agent, or Firm*—Dougherty, Hessin, Beavers & Gilbert

[57] ABSTRACT

A hydraulic jar device for use in through-tubing drilling and fishing operations which consists of an elongate tube having an upper hammer sub, a kelly cylinder and a hydraulic cylinder with central restrictor secured therebelow. A lower sub connects to the bottom end of the hydraulic cylinder. The sliding interior components are an upper mandrel secured to an anvil sub which, in turn, is fastened to an axial plunger, all of which are slidable down within the elongate tube. A metering ring retained on the plunger interacts with the central restrictor of the hydraulic cylinder to control force effected up and down jars that occur when the mandrel strikes the hammer sub on the down stroke, and when the anvil sub strikes the hammer sub bottom on the up stroke.

25 Claims, 7 Drawing Sheets

COIL TUBING HYDRAULIC JAR DEVICE

BACKGROUND OF THE INVENTION

1. Field of the Invention

The invention relates generally to jar devices for use during downhole fishing operations and the like and more particularly, but not by way of limitation, it relates to a dual acting hydraulic jar device that can be actuated through coiled tubing by both lift-up and set-down of supporting string weight.

2. Description of the Prior Art

There have been various forms of prior art jar devices which are extremely effective in loosening stuck pipe by providing a hammer type impact at a desired downhole location. Prior jarring devices are commonly run in conjunction with overshots, spears, etc., to aid in loosening a fish object once it has been caught or secured. Such jarring devices generally utilize energy of compressed fluids to drive a free-moving piston or hammer against the top of the jar device, which fluid compression is obtained by surface movement of the drill pipe or tubing string. Thus, there are various types of hydraulic, mechanical and hydromechanical drilling jars as well as dual acting hydraulic jars that have been utilized in the past, and there is even an up-down jar device which employs both a mechanically operated unit to deliver the down jar and a hydraulically operated unit for delivering the up jar. To Applicants' knowledge there have not been any dual acting hydraulic coil tubing jars.

SUMMARY OF THE INVENTION

The present invention relates to an improved type of hydraulic up/down jar device for use with coiled tubing or conventional workover strings in fishing applications. The device is particularly useful in through-tubing fishing and drilling operations. The jar device consists of a kelly cylinder connected to an intermediate hydraulic cylinder having a cylindrical detent restriction centrally thereof, and which is further connected to a lower sub cylinder. An upper hammer sub is rigidly secured over the top of the kelly cylinder that defines a cylindrical channel through which a mandrel slides reciprocally, such mandrel having a shoulder or striker head on one end and an anvil sub secured on the lower end. The anvil sub is of a diameter that is reciprocal through the kelly cylinder, and the anvil sub carries an elongate actuator rod or plunger for extension down through the hydraulic cylinder and lower sub. Seals between the actuating plunger and the ends of the hydraulic cylinder define a cylindrical space of larger diameter on either side of the restrictor as the regulator plunger carries a piston and metering ring valve through the restrictor circumfery thereby to control hydraulic oil flow from one end of the hydraulic cylinder to the other. This oil flow is controlled in response to mandrel movement in upward or downward mode, from restricted travel to sudden release and jar generation, by impact of mandrel shoulder and anvil surfaces on the downstroke, and the lower anvil and hammer surfaces on the upstroke.

A similar type of device having no restrictor and having the metering ring replaced by seals may be connected in series with the jar device to function as an intensifier and shock absorber. Thus, for example, the lower sub of the intensifier device may be threadedly inserted in the upper end of the mandrel of the jar device and the combination can be utilized to deliver up/down jars to be imparted to the stuck object or fish. While the hydraulic cylinder of the jar device contains a selected volume of hydraulic fluid, the similar sealed chamber in the hydraulic cylinder of the intensifier device contains a full volume of suitably compressible fluid. The intensifier then enables additional energy storing capacity thereby enhancing the impact of the jar device as well as isolating the reverberation whenever a jar is imparted.

Therefore, it is an object of the present invention to provide a jar device that can be utilized in through-tubing fishing and drilling operations.

It is also an object of the invention to provide a jar device that may be utilized to impart sequential up and down impact blows to a stuck object in relatively rapid manner.

It is yet another object to provide a jar device for use in coiled tubing applications.

It is still further an object of the present invention to provide a device of similar structure that can be added in series with the jar device to function as an impact intensifier and isolator.

Finally, it is an object of the present invention to provide an up/down hydraulic jar device for use with coiled tubing that can be easily assembled and reliably employed in the field to impart repetitive freeing blows to downhole stuck objects.

Other objects and advantages of the invention will be evident from the following detailed description when read in conjunction with the accompanying drawings which illustrate the invention.

DETAILED DESCRIPTION OF THE INVENTION

Figure 1A:
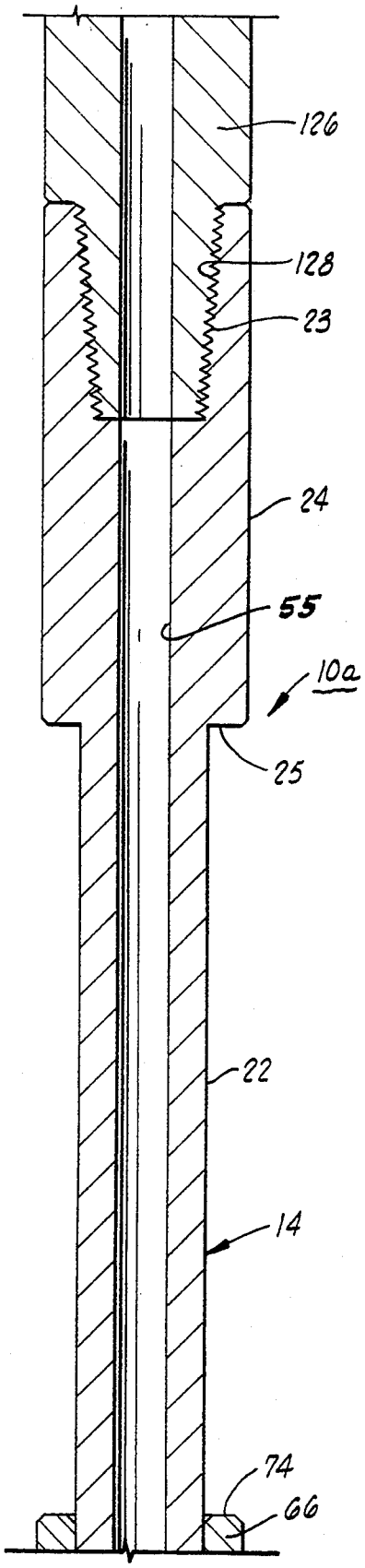
FIGS. 1A, 1B, 1C and 1D are sequential vertical sections of the jar device of the invention shown at the up jar positioning.

Referring to FIGS. 1A to 1D, a jar device 10 consists essentially of an outer cylindrical member 12 having an inner reciprocal member 14 disposed therein for sliding movement. The outer cylindrical member 12 consists of an upper kelly cylinder 16, an intermediate hydraulic cylinder 18 and a lower sub 20. The inner reciprocal member 14 consists of an upper cylindrical piece formed as a mandrel 22 having an annular shoulder 24 with downward-facing annular striker surface 25 formed on the upper end of mandrel 22 and having threads 26 formed around the lower end.

An anvil sub 28 is formed with cylindrical outer surface 29 and an upper annular bore 30 having inner sidewall 32 with threads 34 formed therearound. The annular end surface 36 forms as an up jar striking surface, as will be further described below. The lower end of anvil sub 28 is formed with an axial bore 38 having internal threads 40. Threadedly secured upwardly within bore 38 is a threaded end 42 of an actuating plunger 44. The actuating plunger 44 extends down through the hydraulic cylinder 18 (FIG. 1C) into the lower sub 20 and includes an upper seal face 46 which defines a lesser diameter slide way 48 adjacent to threads 50 having a block nut 52 threadedly secured thereon. A lower plunger 54 extends below threads 50. An axial port 55 extends down through mandrel 22 and plunger 44, 54. A meter ring 56 forming a sliding valve is suitably retained on slideway 48. The diameter of meter ring 56 is a selected small amount less than the inside diameter of a restrictor 58 disposed generally in the center of hydraulic cylinder 18. The restrictor 58 is about two inches in length as it functions with the mandrel plunger 44, seal face 46 and meter ring 56 to actuate the jar device, as will be further described below.

Referring now to the cylindrical outer member, the kelly cylinder 16 includes upper internal threads 60 which receives threads 62 of lower cylindrical end 64 of a hammer sub 66. The hammer sub 66 is generally cylindrical defining an interior bore 68 through which the mandrel 22 is slidingly received. Seal spaces are provided at annular groove 70 below thread engagement and at annular groove 72 above the thread engagement, as the upper portion of hammer sub 66 terminates in an upward facing annular surface 74. The annular hammer surface 74 functions to strike the annular mandrel surface 25 in the downward mode to effect jar impact, as will be further described below.

The kelly cylinder 16 has a cylindrical inner surface 76 for receiving the anvil sub 28 slidably therein as anvil sub outer surface 29 and kelly inner surface 76 are sized for close sliding fit. The lower end of kelly cylinder 16 includes internal threads 78 separating annular interior seal spaces 80 and 82. The hydraulic cylinder 18 then secures threadedly into the lower end of kelly cylinder 16. The upper end of hydraulic cylinder 18 includes a uniform, anvil cylindrical wall 84 which is reciprocally slidable relative to the mandrel plunger 54 and includes a seal gland 86 and suitable seal 87 for sealing around actuator plunger 44. On the outer side, the upper end of hydraulic cylinder 18 includes threads 88 and annular groove 98 for receiving a suitable O-ring 99 of conventional type, and the upper end terminates in a collar 100 for sliding reception of plunger 44. The threads 88 of hydraulic cylinder 18 are placed in secure threaded engagement with threads 78 of kelly cylinder 16.

The lower or box end of hydraulic cylinder 18 includes interior threads 104 as well as an annular relief 106. The interior of hydraulic cylinder 18 provides a uniform diameter chamber for containing hydraulic fluid or selected oil with opposite ends 108 and 110 being divided into essentially equal volume spaces 122 and 124 by the central restrictor 58 of narrower diameter. The restrictor 58 functions during both the upstroke and downstroke of mandrel 22 to control fluid flow easing between metering ring 56 and restrictor 58. Thus, the diameter at restrictor 58 is 1.300 inches (plus or minus 0.005 inches) and the diameter of metering ring 56 is smaller by a predetermined dimension suitable for the particular jar device size and hydraulic fluid viscosity, as will be further described.

The lower sub 20 having pin threads 111 at the bottom defines a cylindrical inner channel 113 which receives overrun of actuator plunger 54. The upper end of lower sub 20 is then received in the lower box end of the hydraulic cylinder 18 with threads 114 securely engaged with the box end threads 104 of the hydraulic cylinder 18. An annular groove 116 provides seating for an O-ring 117 that seals the joint as lower sub 20 terminates at annular end wall 118 while also defining a seal gland 120 housing a suitable form of packing seal 121, a sliding seal disposed tightly around the lower plunger 54. Thus, when the mandrel and actuating plunger are properly placed through hydraulic cylinder 18, a selected hydraulic fluid one-half fills either the upper volume 122 or the lower volume 124, the ends of which are sealed by the respective upper and lower packing seals within seal glands 86 and 120, respectively. An O-ring backed up by carbon packing seal is used in present design; however, special seals for the purpose are available.

Figure 1B:
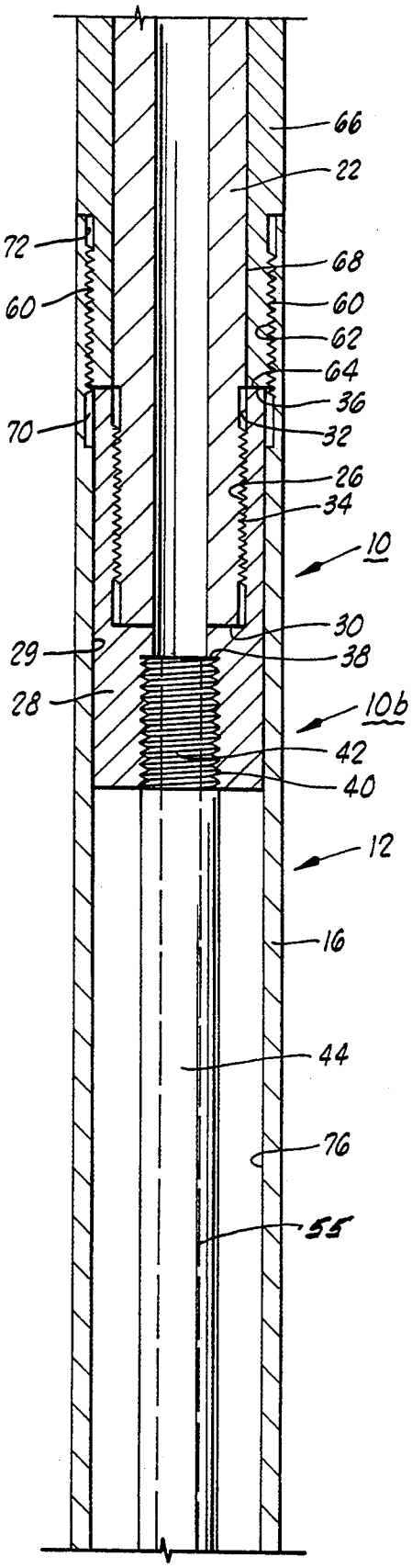

FIGS. 1A through 1D show sequentially the full length of the jar device 10 as it is placed in the jar up attitude with mandrel 22 drawn all the way to its upper limit relative to the hammer sub 66. The hammer sub 66 constitutes the unit which receives impact, downward impact between annular surfaces 25 and 74 (FIG. 1A) and upward impact between annular surfaces 36 and 64 (FIG. 1B).

Figure 1C:
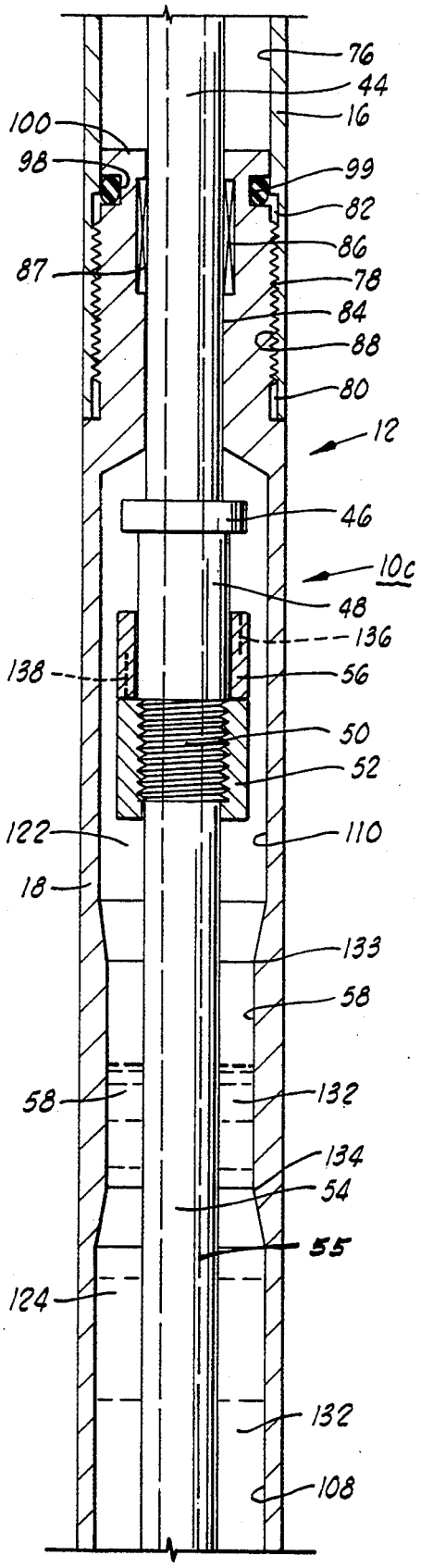
Figure 1D:
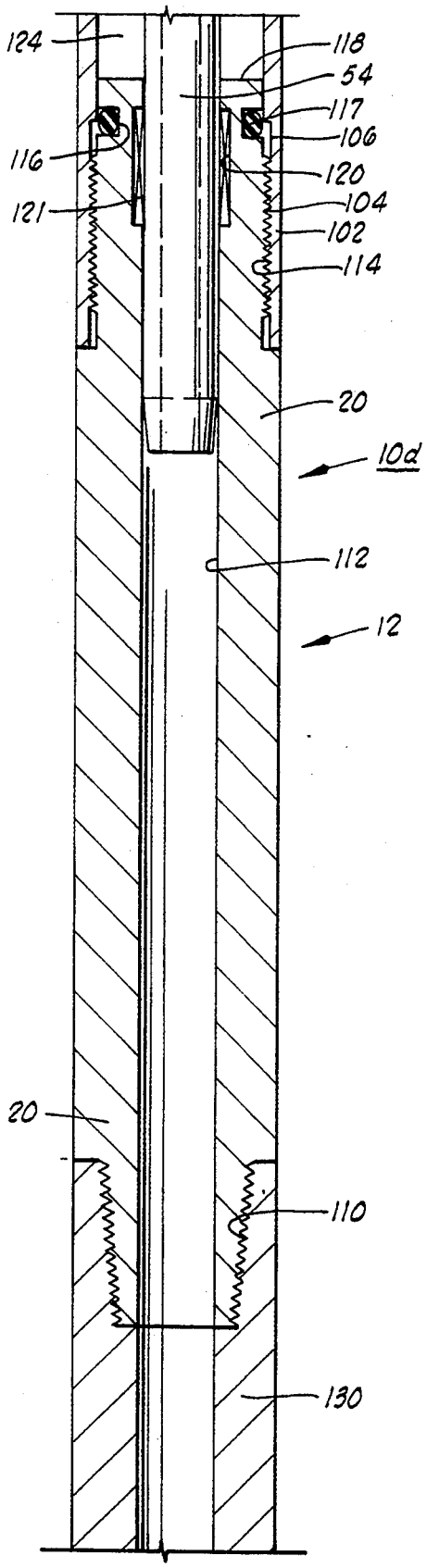

The jar device 10 is supported for operation by connection to a suitable tubing connector or other sub device, e.g., the sub connector 126 having pin threads 128, as shown in FIG. 1A. The sub connector 126 may be affixed to any of continuous tubing, a form of tubing string, or other coacting equipment such as an intensifier and/or shock absorber, as will be further described below. The lower end of jar device 10, as shown in FIG. 1D, may be connected via pin end thread 111 to a tool 130 which serves in some manner to attach to the fish or stuck object that is the subject of operation. Thus, attachment 130 may align and secure any of various tools such as an overshot, a spears tool, tapered tap tool or other forms of specialty fishing tools.

In operating the jar device 10, the hydraulic cylinder 18 is first charged with hydraulic fluid 132 sufficient to fill about one-half of the total volume of upper chamber 122 and lower chamber 124. Actually, the amount of hydraulic fluid 132 employed is approximately eleven ounces by liquid measure, and the hydraulic fluid may range from thinner to thicker fluids depending upon the speed with which the operator desires the jar device 10 to function. The thinner fluids deliver the faster operation and vice-versa.

Once the jar device 10 is readied, the jar device may be run down tubing in contact with the stuck object and with mandrel 22 extended all the way upward relative to positioning in the hammer sub 66 as shown in FIG. 1A. Suitable coiled tubing string weight controlled at the surface is then placed upon the jar device 10 to commence compression and down jar operation, for example 5000 lbs. and up. As shown in FIG. 1C, there is no initial resistance to downward movement of plunger 44 and meter ring 56 until the block nut 52 enters the restrictor 58 and comes into contact with the hydraulic fluid 132. The outside diameter of block nut 52 has narrow clearance relative to restrictor 58 and the slidable meter ring 56 has a clearance of 0.001 inches relative to the inside diameter of restrictor 58 so that even under great weight, the meter ring 56 progresses relatively slowly down through restrictor 58 until it passes the bore point 134 (FIG. 1C) where it then allows relatively free escape of the hydraulic fluid 132 from the lower chamber 124 upward around meter ring 56 and seal plate 46 and, at the same time, allows accelerated downward movement of plunger 44. At the limit of downward fall, the annular mandrel surface 25 impacts with annular hammer surface 74 (FIG. 1A) to provide a down jar to the stuck object as held by sub unit 130.

Figure 4:
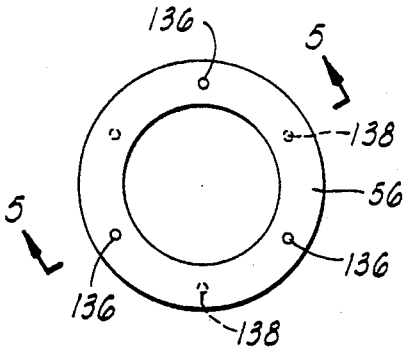
FIG. 4 is a top plan view of a metering ring constructed in accordance with the present invention.
Figure 5:
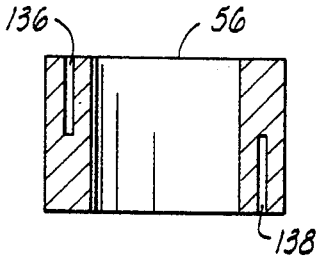
FIG. 5 is a section taken along lines 5—5 of FIG. 4.

Under the very great pressures present in the upper chamber 122 and lower chamber 124 during operation, i.e., fluid pressures on the order of 16–17,000 psi and up, the sidewalls of hydraulic cylinder 18 tend to experience a slight stress enlargement. In order to compensate for such high pressure stress enlargement, the meter ring 56 includes a plurality of upper relief holes 136 and lower relief holes 138 which are each drilled halfway through the vertical dimension of meter ring 56 and serve to impart an enlarging effect as higher pressure fluid is applied. As shown in FIGS. 4 and 5, the meter ring 56 includes a plurality of equi-spaced vertical holes 136, on the order of six to eight holes, drilled from the top halfway down through the vertical dimension of meter ring 56. Alternatively, for pressure equalization during opposite direction movement, a similar plurality of equi-spaced holes 138 are formed in offset from the bottom of meter ring 56 to a point halfway along the height. The holes 136 and 138 are each formed with a diameter of 0.030 inches in present design.

Figure 2A:
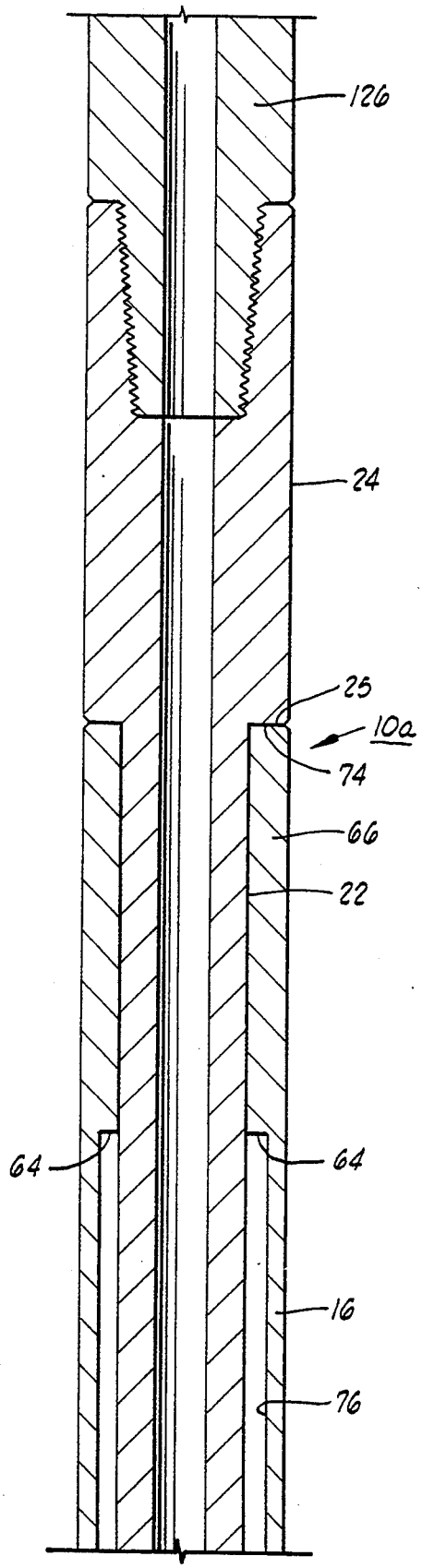
FIGS. 2A, 2B, 2C and 2D are sequential views in vertical section of the jar device in the lowermost or down jar position.
Figure 2B:
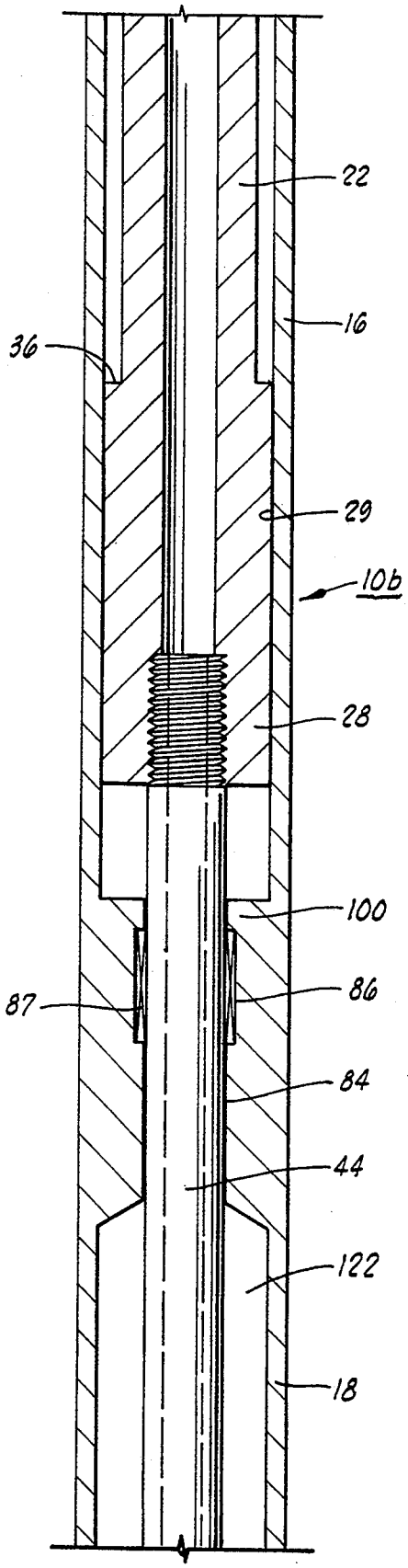
Figure 2C:
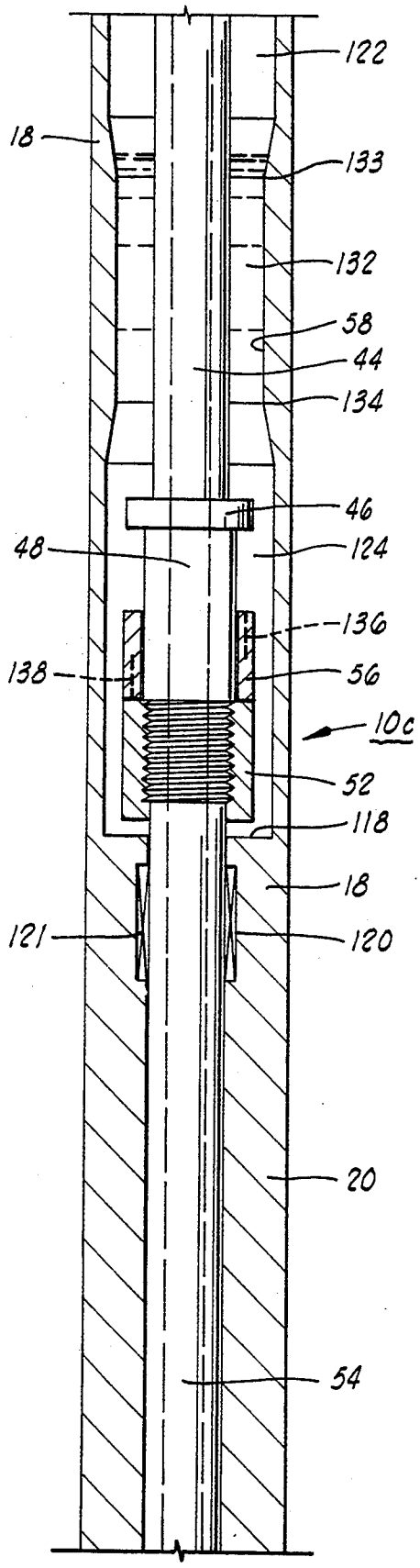
Figure 2D:
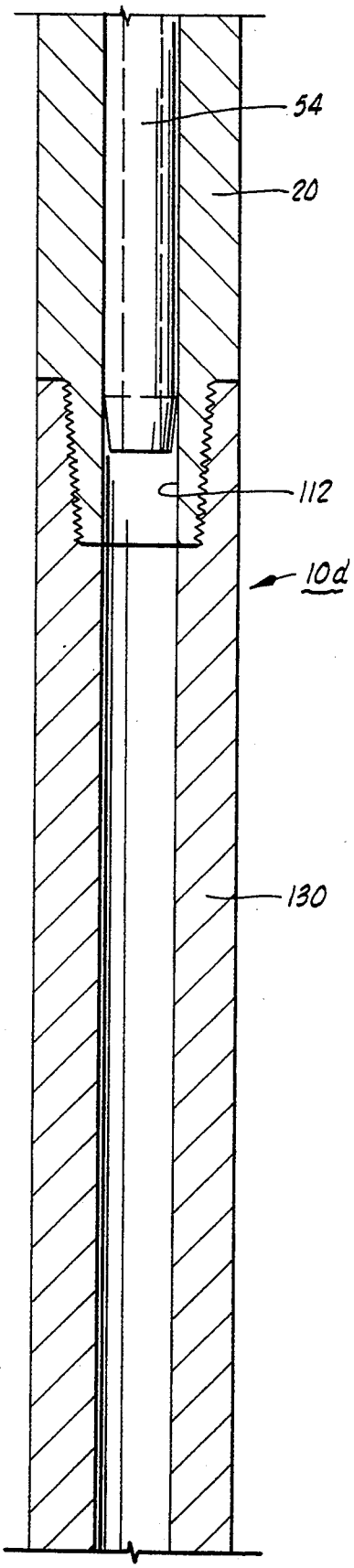
Figure 3A:
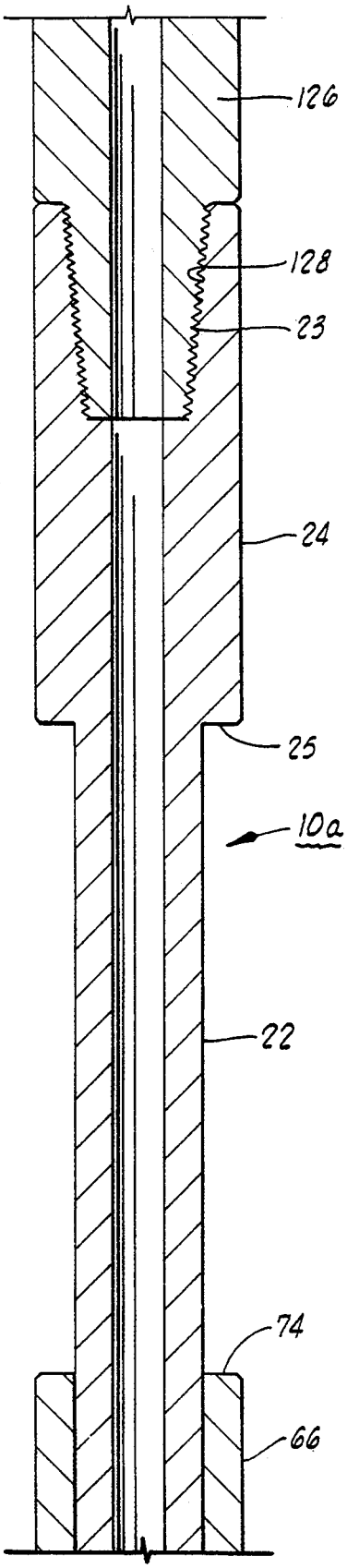
FIGS. 3A, 3B, 3C and 3D are sequential views in vertical section of the jar device nearing completion of an up jar stroke.
Figure 3B:
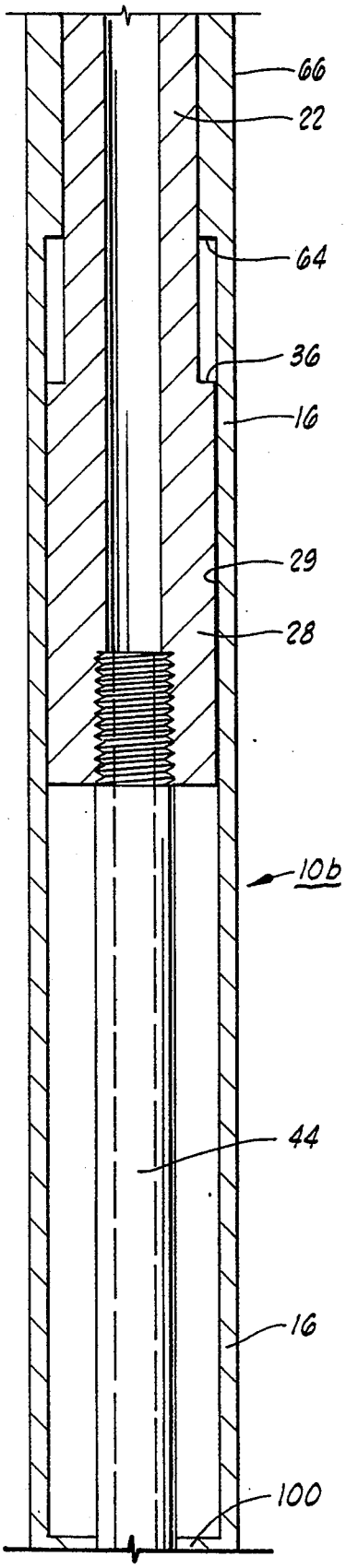
Figure 3C:
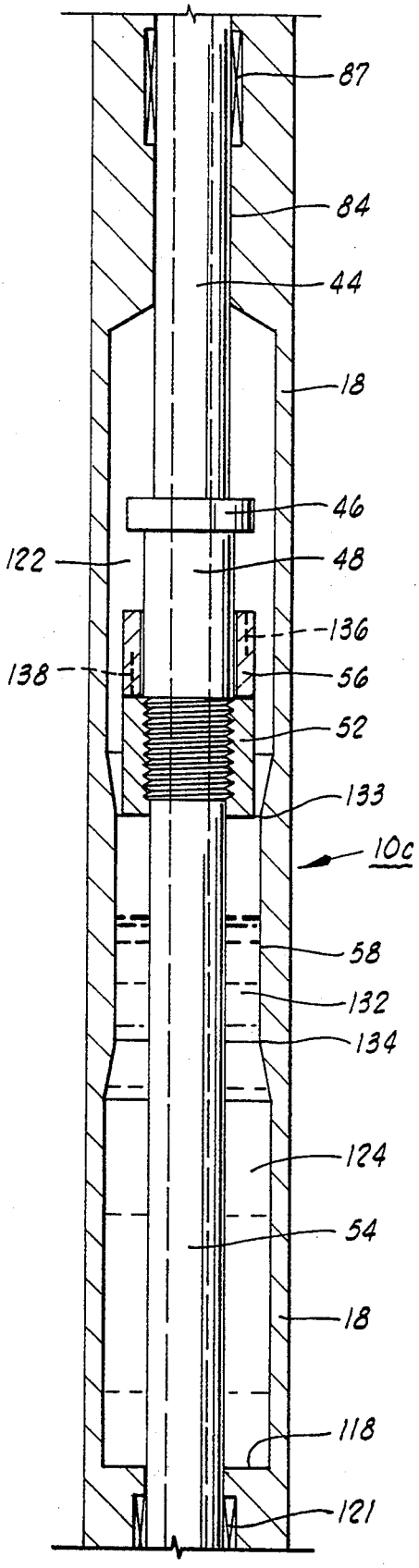
Figure 3D:
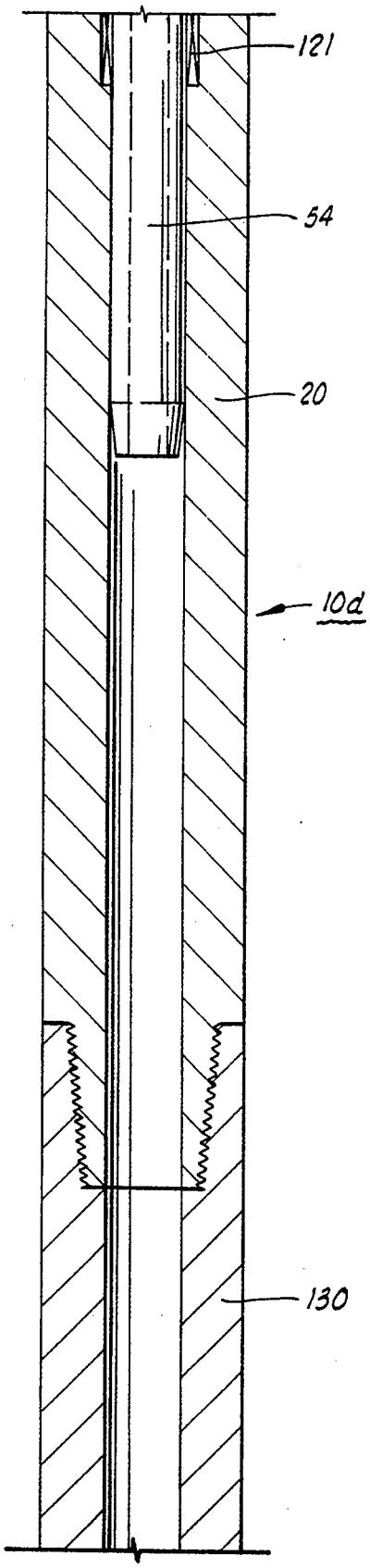

Referring to FIGS. 2A through 2D, the jar device 10 is in the attitude just following a down jar wherein mandrel annular surface 25 has impacted on annular hammer surface 74 as shown in FIG. 2A. At this point, the mandrel 22 is at its lowest extremity positioning anvil 28 downward adjacent collar 100 of hydraulic cylinder 18, and the seal face 46 and meter ring 56 are disposed in the lower chamber 124 of hydraulic cylinder 18, well below the level of hydraulic fluid 132 which is raised up to about the upper bore point 133 of restrictor 58. In like manner, the lower plunger 54 is positioned all the way down within lower sub 20 and adjacent the lower sub connector 130.

The up jar is commenced by applying lift up force on the coiled tubing string which has the effect of drawing mandrel 22 upward thereby to commence the up jar sequence. As the mandrel 22 is drawn upward, the plunger 44 is drawn steadily upward to bring the seal face 46 and meter ring 56 up across lower bore point 134 into restrictor 58. This brings the seal plate 46 up into restrictor 58 with minimal fluid restriction until the close fitting meter ring 56 passes the lower bore point 134 to carry the hydraulic fluid 132 trapped thereabove upward until compression of remaining air and hydraulic fluid above the meter ring 56 whereupon the meter ring 56 slowly leaks hydraulic fluid around its circumfery. The circumference of meter ring 56 has about 0.001 inches clearance relative to the side wall of restrictor 58 and, in response to the extreme pressures within hydraulic cylinder 18, the upper holes 136 around meter ring 56 will expand under fluid pressure to maintain the clearance constant relative to the slightly expanding inner diameter of restrictor 58.

FIGS. 3A through 3D show the attitude of jar device 10 at a point in upward traverse of mandrel 22 where the hydraulic fluid 132 can enjoy free flow of fluid around the meter ring 56 and components, and the full upward force can act to raise the plunger 44 (FIG. 3B) to force the anvil 28 rapidly upward thereby to impact the annular anvil surface 36 against the annular hammer surface 64 to effect the up jar.

After the up jar, the jar device 10 is once again in the attitude depicted in FIGS. 1A through 1D and ready for commencement of a down jar sequence. Thus, by periodically shifting the applied weight and liftup to the coiled tubing, as controlled from the surface, the jar device 10 can be sequenced through repeated up and down jars of the fish until it is freed for movement by the sub attachment 130.

Figure 6:
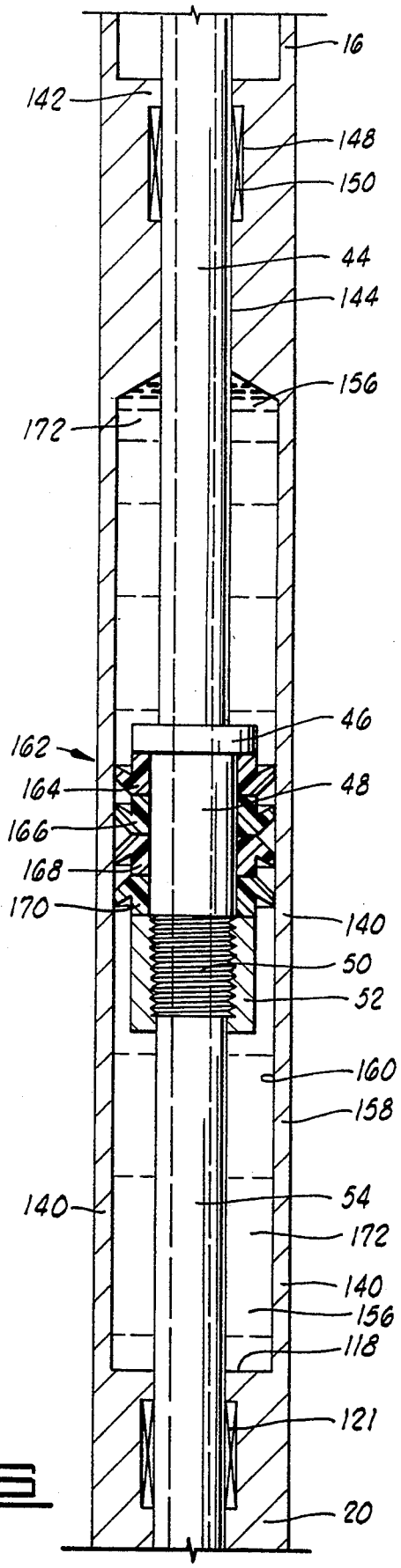
FIG. 6 is a view in vertical section of an alternative form of hydraulic cylinder which converts the jar device to an intensifier unit.

The jar device 10 has the capability of being altered to what is termed an intensifier by changing out a single component. Thus, when the detent cylinder 18 of jar device 10 is substituted with a hydraulic cylinder 140, as shown in FIG. 6, the device becomes an intensifier capable of intensifying or accelerating the impact of jar device 10 while also serving as a shock absorber as regards vibrations attempting to travel thereacross. The alterations are essentially directed to elimination of the restrictor 58, replacement of the metering ring 56 with a plurality of slidable seals, and replacement of the hydraulic fluid 132 with a full chamber of a selected compressible fluid, as will be further described.

The intensifier 140 is still interconnected between kelly cylinder 16 and a lower sub 20 as intensifier 140 still retains the similar end connector components as the hydraulic cylinder 18. Thus, the upper end of intensifier cylinder 140 still has an upper collar 142 and axial bore 144 with outer threads formed for engagement with kelly interior threads 78. See FIG. 1C. An annular seal gland 148 provides seating for a tube seal 150 while an upper annular groove provides seating for a standard type of O-ring (FIG. 1C).

The axial bore 144 leads downward into a generally cylindrical elongate chamber 156 which is defined by the outer wall 158 having an inner surface 160. The chamber 156 terminates at the bottom at annular collar 118, the end wall of lower sub 20, as it is engaged with lower internal threads of intensifier cylinder 140. The packing seal 121 and O-ring remain functional as in the previous embodiment of jar device 10.

The same type of upper plunger 44, seal face 46, threads 50, block nut 52 and lower plunger 54 are employed in the FIG. 6 intensifier embodiment. The difference here is the employment of a seal assembly 162, four cup-shaped seals 164, 166, 168 and 170, which is compressed between seal face 46 and block nut 52. Each of the seals 164–170 are identical except that they are positioned in two by two relationship with the upper two seals 164 and 166 aligned with cup up and the lower two seals 168 and 170 aligned with cup down. The seals 164–170 are made of TEFLON® and specially constructed by Johns Manville to provide a tight seal withstanding up to 20,000 psi. In assembly, the seals are subjected to 0.013 inches squeeze suppression by adjustment of block nut 52. A compressible liquid 172, a selected Dow-Corning silicon fluid type completely fills the chamber 156.

In operation, an intensifier unit is assembled consisting of a hammer sub 66, connected to a kelly cylinder 16 (FIGS. 1A and 1B) which is then connected to an intensifier hydraulic cylinder 140 (as in FIG. 6) with attachment of lower sub 20. The interior moving element would consist of the mandrel 22 connected to the anvil 28 which extends the plunger 44–54 down through the axial kelly cylinder 16 and accelerator chamber 156 within hydraulic cylinder 140. Within chamber 156, the plunger 44 would include the seal face 46, plural opposed cup-shaped seals 164–170 and the block nut 52 securing the seal assembly 162. A complete charge of compressible oil of selected type is placed within chamber 156. With the seal assembly 162 positioned near the top of chamber 156, the intensifier unit could be utilized for down jar only. With seal assembly 162 in the middle of chamber 156, the intensifier unit is usable for both up and down jar operation, and when the seal assembly 162 is at the bottom of chamber 156 it is suitable for use in up jar applications. The initial positioning of the mandrel 22 may be attended by the operator on commencement of operation when oil filling takes place.

The intensifier unit may be placed directly in connection with the jar device 10 by threadedly interconnecting the coupling units. That is, the pin end threads 110 of a lower sub 20 of the intensifier unit could be connected directly into the box threads 23 of mandrel 24 on the jar device 10. In some cases, however, there may be other intervening sub units included between the intensifier unit and a jar device 10. Also, in cases where only the shock absorption feature is to be availed of, the properly assembled intensifier unit may be used separate and apart from the jar device 10.

The intensifier unit serves to intensify acceleration of the jarring member during both up and down jar impacts, while also functioning as a shock absorber as regards any impact vibration that attempts to travel up the tool string from the work point, i.e., the point where the object or fish is receiving jars. Thus, as weight bears down upon the intensifier plunger 44 and the plural cup-shaped seals 164–170, increasing pressure and therefore energy is stored within the volume of compressible fluid 172 therebeneath. When the jar device 10 completes its bleed-down phase, that is (referring to FIG. 1C) when the meter ring 56 has cleared the restrictor 58 and descends below bore point 134, the plunger 44–54 accelerates rapidly to impact causing the requisite jar. Also, this acceleration is greatly aided by the acceleration energy that is stored in the compressible fluid within the hydraulic cylinder 140 of the intensifier unit. This same jar intensity augmentation is realized whether the combination operates in up jar, down jar or up-down jar modes.

While providing the intensifying function by means of the pressure seal assembly 162 as retained on slideway 48, the structure also has the capability of absorbing any shock transmitted along or through hydraulic cylinder 140 as such vibrational energy is dissipated within the compressible fluid 172. In order to achieve purely shock absorption effectiveness, it is best that the hydraulic cylinder 140 be loaded initially at the center position of chamber 156 with ample room for movement in either direction.

The foregoing discloses a novel downhole tool that may be used with coiled tubing as an up/down jar device capable of delivering repeated up and down blows to a stuck object at a relatively rapid rate of repetition. In addition, the jar device exhibits great versatility both in implementation as a jar generator and for other functions which are enabled by merely offering the characteristics of a central hydraulic cylinder and piston assembly. In the one case, a two-way hydraulic cylinder with a central restrictor is utilized for function in the up or down jar mode of operation while a quick changeover of the hydraulic cylinder, to one of a cylinder without restriction and a high pressure seal type of piston, enables operation as an impact intensifier or accelerator as well as a shock absorber for isolating impact disturbance.

Changes may be made in the combination and arrangement of elements as heretofore set forth in the specification and shown in the drawings; it being understood that changes may be made in the embodiments disclosed without departing from the spirit and scope of the invention as defined in the following claims.

What is claimed is:

1. A jar device for suspension from coil tubing to loosen a stuck object, comprising:

a tubular body having an upper end and an axial opening therethrough, and being positively coupled to a gripping means that can be secured to the stuck object;

a mandrel including an impact surface and being connected to an actuating plunger that extends reciprocally down through said axial opening;

connector means securing said mandrel upper end to the coil tubing to place vertical push and pull forces selectively on said mandrel;

a hydraulic cylinder with a central fluid restrictor of reduced diameter formed generally centrally along said tubular body axial opening;

a volume of fluid filling said hydraulic cylinder to approximately half full; and a metering ring disposed on said actuating plunger and being reciprocal up and down through the hydraulic cylinder and central fluid restrictor in response to said vertical push and pull forces on said mandrel;

whereby said metering ring and central restrictor coact on both the up and down mandrel reciprocations to delay plunger movement for subsequent release and accelerated movement to impact in both the up and down reciprocations.

2. A jar device as set forth in claim 1 wherein said mandrel comprises:

an elongate cylindrical body having an annular shoulder formation on the top, said formation providing a downward facing annular impact surface for striking the tubular body upper end when the mandrel cylindrical body moves down within the tubular body axial opening; and an anvil sub secured to the lower end of said cylindrical body and being threadedly secured to said plunger extending axially therebelow.

3. A jar device as set forth in claim 1 wherein said tubular body further comprises:

a kelly cylinder defining a cylindrical passageway with the lower end being threadedly connected to said hydraulic cylinder;

a hammer formed as a collar threadedly received over the upper end of said kelly cylinder; and a lower sub threadedly secured and extending beneath said hydraulic cylinder.

4. A jar device as set forth in claim 2 wherein said tubular body further comprises:

a kelly cylinder defining a cylindrical passageway with the lower end being threadedly connected to said hydraulic cylinder;

a hammer formed as a collar threadedly received over the upper end of said kelly cylinder; and a lower sub threadedly secured and extending beneath said hydraulic cylinder.

5. A jar device as set forth in claim 1 wherein:

said hydraulic cylinder is approximately half full of relatively compressible hydraulic fluid; and said metering ring can pass through said central restrictor with minimal clearance that retards simultaneous oil passage therethrough.

6. A jar device as set forth in claim 1 wherein:

said central restrictor is of narrower diameter than the remaining hydraulic cylinder portions and constitutes approximately one-fifth of the hydraulic cylinder total volume.

7. A jar device as set forth in claim 6 wherein:

said hydraulic cylinder is approximately half full of relatively compressible hydraulic fluid; and said metering ring can pass through said central restrictor with minimal clearance that retards simultaneous oil passage therethrough.

8. A jar device as set forth in claim 5 wherein said metering ring further includes:

a plurality of small, equi-spaced holes formed on each side of the ring and extending about half way therethrough, said holes on each side being aligned to avoid intersection;

whereby the holes under fluid pressure serve to expand the metering ring diameter thereby to maintain constant the clearance between the metering ring and the central restriction when pressurized.

9. A jar device as set forth in claim 4 wherein:

said anvil sub includes an upper annular impact surface; and said hammer is formed with a downward facing annular impact surface;

whereby the upper impact surface and downward facing impact surface strike to effect a jar on the up stroke of the mandrel and plunger.

10. A jar device as set forth in claim 4 which is further characterized to include:

an upward facing, annular impact surface formed on the top of the hammer collar;

whereby the annular impact surface of the hammer strikes the downward facing impact surface on said mandrel to effect a jar on the down stroke of the mandrel and plunger.

11. A jar device as set forth in claim 5 which is further characterized to include:

upper and lower seal packings disposed around said plunger at each end of said hydraulic cylinder.

12. A jar device as set forth in claim 1 wherein:

each of said mandrel and actuating plunger has an axial port to allow fluid passage through said jar device.

13. A jar device for suspension from coil tubing for contact with a stuck object in a well bore, comprising:

a tubular body having an upper end and an axial bore extending therethrough, said tubular body being positionable in contact with said stuck object;

a mandrel having an annular impact surface and extending a cylindrical body down within said axial bore;

means connecting the mandrel to said coil tubing;

a tubular plunger extending axially downward from said mandrel cylindrical body through said axial bore;

a hydraulic cylinder having a central fluid restrictor of reduced diameter formed generally centrally along said tubular body axial bore;

a metering ring disposed on said tubular plunger and being reciprocal through the hydraulic cylinder and central fluid restrictor; and a volume of fluid approximately half filling said hydraulic cylinder;

whereby said metering ring and central restrictor coact in response to up and down forces on said mandrel to delay plunger movement for subsequent release and accelerated movement to impact.

14. A jar device as set forth in claim 13 wherein said mandrel comprises:

an elongate cylindrical body having an annular shoulder formation on the top, said formation providing a downward facing annular impact surface for striking the tubular body upper end when the mandrel cylindrical body moves down within the tubular body axial opening; and an anvil sub secured to the lower end of said cylindrical body and being threadedly secured to said plunger extending axially therebelow.

15. A jar device as set forth in claim 13 wherein said tubular body further comprises:

a kelly cylinder defining a cylindrical passageway with the lower end being threadedly connected to said hydraulic cylinder;

a hammer formed as a collar threadedly received over the upper end of said kelly cylinder; and a lower sub threadedly secured and extending beneath said hydraulic cylinder.

16. A jar device as set forth in claim 14 wherein said tubular body further comprises:

a kelly cylinder defining a cylindrical passageway with the lower end being threadedly connected to said hydraulic cylinder;

a hammer formed as a collar threadedly received over the upper end of said kelly cylinder; and a lower sub threadedly secured and extending beneath said hydraulic cylinder.

17. A jar device as set forth in claim 13 wherein:

said hydraulic cylinder is approximately half full of hydraulic fluid; and said metering ring can pass through said central restrictor with minimal clearance that retards simultaneous oil passage therethrough.

18. An intensifier unit for use in suspension from coil tubing in through-tubing well applications, comprising:

an elongate tubular body having an upper end with an axial bore that extends through the lower end;

a mandrel disposed reciprocally in said axial bore upper end and extending a plunger through said axial bore lower end;

connector means securing said mandrel upper end to the coil tubing to place vertical push and pull forces selectively on said mandrel;

a hydraulic cylinder full of a compressible fluid formed along said axial bore lower end in sealed relationship to said plunger;

an upper seal face having a lesser diameter slideway retained on said plunger at approximately the middle of said hydraulic cylinder;

a plurality of cup-shaped resilient seals compressibly retained on said slideway against said upper seal face, selected ones of said cup-shaped seal being oppositely oriented; and means for connecting said intensifier unit in series with a jar device to accelerate jar impact.

19. An intensifier unit as set forth in claim 18 wherein said plurality of cup-shaped resilient seals comprises:

a first plurality of upward oriented cup-shaped seals tightly received within said hydraulic cylinder adjacent the upper seal face; and a second plurality of oppositely oriented cup-shaped seals tightly received within said hydraulic cylinder below said first plurality of cup-shaped seals.

20. An intensifier unit as set froth in claim 18 which is further characterized to include:

an axial port formed through said mandrel and said plunger to conduct fluid through said intensifier unit.

21. A jar device as set forth in claim 13 wherein said means connecting includes an intensifier unit comprising:

a second elongate tubular body having an upper end and lower end and an axial bore extending through the lower end, said second tubular body lower end being secured to said jar device mandrel;

a second mandrel connected to said coil tubing and disposed reciprocally in said tubular body axial bore upper end to extend a plunger through said axial bore lower end;

a second hydraulic cylinder filled with compressible fluid formed along said axial bore lower end in sealed relationship to said plunger; and a seal assembly retained on said plunger at approximately the middle of said hydraulic cylinder;

whereby said second hydraulic cylinder provides jar intensification as well as absorption of shock vibrations.

22. A jar device in combination with an intensifier unit as set forth in claim 21 wherein said seal assembly comprises:

a plurality of sliding circular seals tightly received within said hydraulic cylinder.

23. A jar device in combination with an intensifier unit as set forth in claim 21 which further includes:

an axial port formed through said mandrel and said plunger for conduction of fluid through said intensifier unit.

24. A jar device in combination with an intensifier unit as set forth in claim 22 wherein:

said seal assembly consists of two opposed cup seal combinations maintained on said plunger under preselected tension.

25. A jar device in combination with an intensifier unit as set forth in claim 21 wherein:

said compressible fluid is a silicone fluid of selected compressibility.

* * * * *